United States Patent [19]

Anderson et al.

[11] 4,005,533

[45] Feb. 1, 1977

[54] INSTEP CRAMPONS

[76] Inventors: Gordon K. Anderson, 14632 Pacific St.; Steven M. Leuck, 14801 Briarcliff Place, both of Tustin, Calif. 92680

[22] Filed: Nov. 7, 1975

[21] Appl. No.: 629,770

[52] U.S. Cl. ..... 36/62; 36/7.7

[51] Int. Cl.[2] ..... A43C 15/00; A43B 3/18

[58] Field of Search ..... 36/62, 7.6, 7.7

[56] References Cited

UNITED STATES PATENTS

| | | | |
|---|---|---|---|
| 2,216,947 | 10/1940 | Jones | 36/7.7 |
| 2,366,649 | 1/1945 | Priess | 36/62 |
| 2,972,823 | 2/1961 | Bailey | 36/62 |

*Primary Examiner*—Patrick D. Lawson

[57] ABSTRACT

This invention broadly relates to instep crampons for footwear and more specifically to improvements on a quick detachable, anti-slipping device which can be readily mounted on a boot or shoe with a novel strapping arrangement providing traction for walking on ice or crusted snow.

1 Claim, 5 Drawing Figures

INSTEP CRAMPONS

A variety of traction footwear of the so-called "crampon" type have heretofore been used or proposed for use which are constructed to cover the entire foot area causing rapid fatigue to the wearer and being heavy, awkward and bulky. In accordance with the invention, the crampon covers only the instep of the shoe or boot and provides unrestricted movement of the ice or snow engaging spikes relative to the wearer and creates walking characteristics not unlike that encountered on conventional footwear. This improvement not only greatly enhances the comfort of the wearer but is small, lightweight and easily carried when not in use. The invention is primarily used for walking tours, backpacking and walking on icy surfaces whereas the conventional so-called "crampon" type are basically utilized in Alpinism, mountain hiking and technical climbing.

The main object of the invention is in the provision of novel attachment where in a structure with a plurality of non-slipping teeth or spikes can be readily and conveniently worn on footwear so as to avoid slipping when walking or hiking. The attachment being accommodated in the arch area of footwear between the forward edge of the heel and sole.

Another object of the invention is the provision of an attachment wherein the device is secured by means of multiple straps so positioned that the crampon will not come loose from the wearer.

Yet another object of the aforementioned attachment, provides convenient adjustment to accommodate any size boot or shoe and is quickly and easily removed with no damage to footwear through the use thereof.

Still another object of the present invention is to provide a device which is simple in design, economical in manufacture, thoroughly reliable and efficient in operation, readily and easily fitted onto footwear without inconvenience to the wearer, eliminates discomfort in the use of the same and assures firm walking or hiking activities.

These and other objects and advantages of the present invention will become apparent from the subsequent detailed description and the appended claims taken in conjunction with the accompanying drawings in which:

Figure 1:
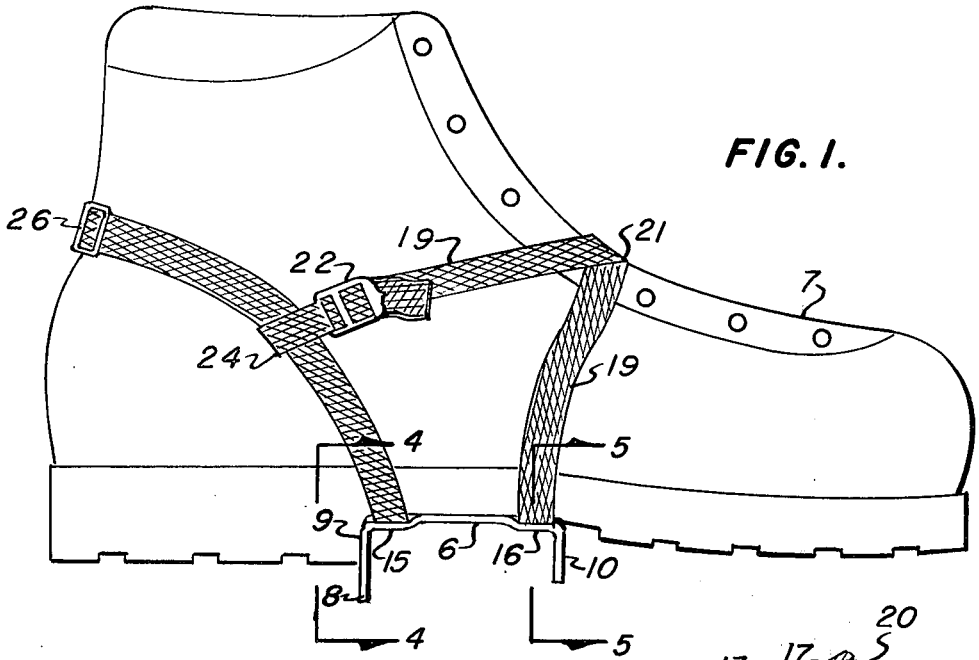
FIG. 1 is a side view of the instep crampon as attached to and worn on a boot.

Referring now in detail to the drawings and describing the preferred embodiment, the invention consists of a metal structure 6 substantially a channel configuration conforming to the instep of a shoe or boot 7 and the width to accommodate small or larger sizes.

The rear leg of the channel shape is in intimate contact with the heel of the boot or shoe 7 and consists of a plurality of spikes or cleats 8 being sharp to provide positive grip. The rearward channel leg 8 is longer than the front 10 with a section 9 unnotched to provide additional strength and allow for the difference in height of the sole and heel. The forward plurality of teeth or spikes 10 are flat and have a sharpened flat triangular shape. The extensions are folded 90° down from the top flat surface.

Figure 2:
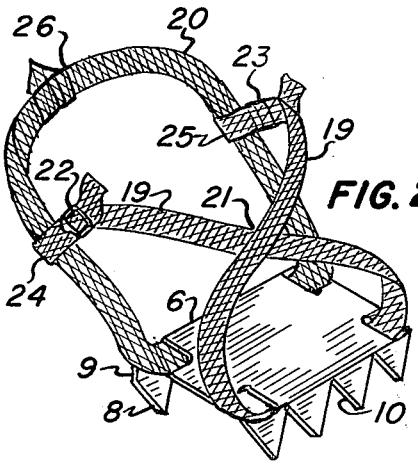
FIG. 2 is a view in perspective depicting the crampon with attaching straps per se.
Figure 3:
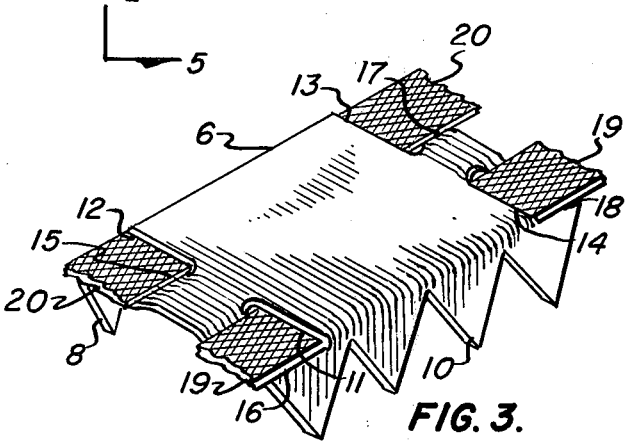
FIG. 3 is a perspective view of the crampon with the attachments cut away for clarity.
Figure 4:
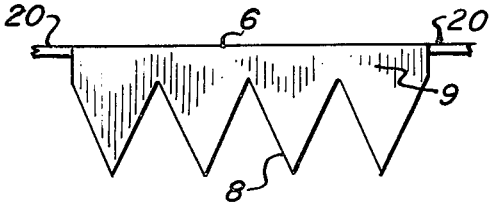
FIG. 4 is a longitudinal view taken substantially along the line 4—4 of FIG. 1 looking in the direction of the arrows.
Figure 5:
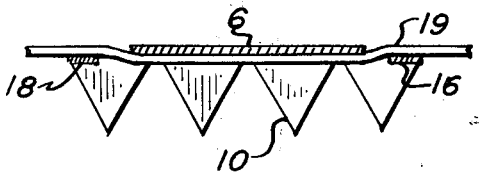
FIG. 5 is a sectional view taken on the line 5—5 of FIG. 1 looking in the direction of the arrows.

On either side of the top or instep portion are a pair of elongated slots 11 and 12, extending parallel to the outside surface. On the other side are a further pair of elongated slots 13 and 14 exactly opposite and in a like position. These slots 11 thru 14 are adapted to receive straps that extend under the instep portion and may by fastened around the top of conventional footwear as shown in FIG. 2. The flat area between the slots 11 thru 14 and the outside edge are upset from the top surface 15 thru 18 the exact thickness of the strap providing protection for the edge of the strap and allowing even penetration of the strap.

The strapping arrangement is comprized of two individual straps 19 and 20 which utilizes a pliable or flexible material such as woven nylon for example or other suitable material or synthetic materials such as cotton webbing, polyvinyl chloride or leather. The forward securing strap 19 is trained through the slots 11 and 14, under the crampon and encircle the footwear crossing at the top 21 and attaching to a buckle at points 22 and 23. Correspondingly, the buckles 22 and 23 are likewise attached to the rear strap 20 with a captive device 24 and 25 of similar material to the strap or metalic. The rear strap 20 in like manner is attached to the crampon through slots 12 and 13 and circle the heel of the footwear and is held in place with a fastener or buckle 26 securing the device tightly against the heel.

While the invention has been described in complete detail and pictorially shown in the accompanying drawing, it is not to be limited to such details since many changes and modifications may be in the invention without departing from the spirit and scope thereof. Hence, it is described to cover any and all modifications and forms which may come within the language and scope of the appended claim.

We claim:

1. An instep crampon for footwear in general of the kind described, comprizing a substantially channel shaped metallic plate, of a width appropriate to the instep of a boot or shoe, stamped and formed to size having a plurality of downward depending spikes of varying height on front and rear legs of the channel, with multiple spaced parallel slots upset from the edge to provide for attachment of a plurality of flexible straps including front and rear straps, slidably connected to the said plate through the parallel slots the front strap attaching to the footwear around the instep over the arch of the foot and fastened releaseably to a slidable attachment connected to the rear strap which is attached to the plate in like manner and embraces the perifery of the heel to provide support for the front strap arrangement.

* * * * *